United States Patent [19]

Haza

[11] Patent Number: 4,778,178

[45] Date of Patent: Oct. 18, 1988

[54] ADJUSTABLE GRIP FOR BOWLING BALL

[76] Inventor: Robert R. Haza, 2134 Gardner Rd., Westchester, Ill. 60153

[21] Appl. No.: 44,515

[22] Filed: Apr. 30, 1987

[51] Int. Cl.[4] ..... A63B 37/00

[52] U.S. Cl. ..... 273/63 B

[58] Field of Search ..... 273/63 A, 63 B, 63 R, 273/63 E

[56] References Cited

U.S. PATENT DOCUMENTS 4,560,162 12/1985 Miller ..... 273/63 B

*Primary Examiner*—George J. Marlo

*Attorney, Agent, or Firm*—Laff, Whitesel, Conte & Saret

[57] ABSTRACT

An insert is provided for varying the inside diameter of a hole in a device such as a bowling ball. The insert has a coaxial pair of telescoped tubes permanently joined together and a ramp section that is mounted at its base to a ring member. The ramp and ring are located between the telescoped tubes and can be rotated relative to the telescoped tubes. The inner telescoped tube is constructed of a flexible material, and its outside shell has a boss that separates two recesses. The ramp section decreases in thickness across its width. The cylindrical ring member terminates at its base in a slot. Upon inserting a driver into the slot means and turning, the cylindrical ring member and ramp section rotate relative to the stationary telescoped tubes. When the hole is at its maximum diameter, the ramp section rotates, with its thinner end first, onto the boss, thereby depressing a portion of the inner tube and constricting the diameter of the hole. Since the ramp section has variable thickness, the extent of constriction of the hole varies with the degree of rotation of the slot. A cap fixed to the outer tube has a serrated edge for engaging the serrated edge of the cylindrical ring member, thereby locking the insert to a desired degree of constriction.

8 Claims, 2 Drawing Sheets

ADJUSTABLE GRIP FOR BOWLING BALL

This invention relates to means for constricting the diameter of a hole, and more particularly, to inserts for adjusting the size of a finger or thumb hole in a bowling ball or the like.

Bowling balls exemplify a situation where a precisely drilled hole is located in a relatively hard object. Generally, a certain bowling ball is satisfactory only to a limited group of people since the hole size of that bowling ball prevents use by people with different size fingers. As used herein, the word "finger" is intended to include any of the five digits of the hand.

The prior art reveals several methods to narrow the hole diameter. One practice is to fasten some kind of a ring inside an oversized hole, the ring having a desired fixed inside diameter. This procedure generally requires the specialized equipment of, and installation by a pro shop. U.S. Pat. No. 4,561,654 teaches a hole insert comprised of two telescoping tubes that turn relative to each other. The inside tube has a conical wedge shaped top that confronts a conical wedge shape of a flexible insert. By turning one of the tubes, the conical wedges advance toward or retreat from each other to constrict or relax the diameter. This constricts the hole annularly over a small area near the opening of the bore and the constriction may catch the bowler's knuckle. U.S. Pat. No. 4,560,162 teaches an insert in a thumb hole of a bowling ball which is manually adjustable to constrict the opening. A screw is threaded directly against a movable shoulder which narrows the diameter of the thumb hole. Unscrewing or reversal of the screw causes the shoulder to move outwardly towards its original position to enlarge the opening.

Accordingly, one object of the present invention is to provide new and novel means for and methods of constricting the diameter of a hole, especially a finger hole in a bowling ball. Another object is to provide a hole insert for adjustably constricting the diameter of an existing finger hole of a bowling ball. Other objects of the invention will in part be obvious and in part appear hereinafter.

SUMMARY OF THE INVENTION

An insert or liner for the hole of a bowling ball is manually adjustable to narrow the hole opening. The insert is comprised of two telescoped tubes that are joined together to prevent rotation of the tubes relative to each other. The inner tube has an elastic surface with at least one vertical boss on its outer surface. A cylindrical ring member with at least one ramp section is positioned between the two telescoped tubes and rotates relative to the telescoped tubes. The ring member terminates in a slot. By using the slot to turn the ring member, the ramp section is rotated onto the boss, thereby pushing the elastic portion of the inner tube inwardly and narrowing the opening of the hole.

DETAILED DESCRIPTION OF THE INVENTION

Figure 1:
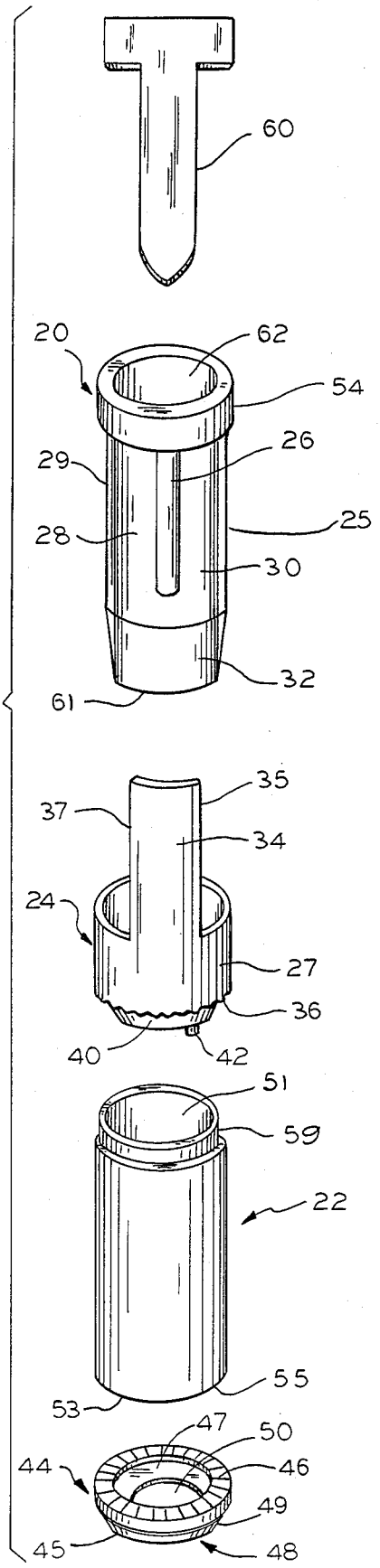
FIG. 1 is an exploded view of a preferred embodiment of the invention.

The exploded view of FIG. 1 shows a pair of telescoped tubes 20, 22, a cylindrical ring member 24, cap 44 and driver 60. Tube 20 is hollow and is constructed of a flexible material. The outer shell 25 preferably has at least two recesses 28, 30, a boss 26, and a surface 29. Recesses 28, 30 are on the outer shell 25 of tube 20, and a boss 26 separates the two recesses 28, 30. The recesses are recessed relative to both the boss 26 and the surface 29 on outer shell 25 of tube 20. The top of tube 20 has a lip 54 extending outwardly from the outer shell 25 at the top of tube 20. Tube 20 also has a truncated conical wedge part 32 at its base which flares inwardly, leaving a bottom opening 61 which is smaller in diameter than top opening 62.

A recessed portion 59 extends around the top end of tube 22 to form an upper opening 51 which is smaller in diameter than lower opening 53, located at the opposite end of tube 22. When telescoped together, recessed portion 52 receives lip 54 of tube 20 so that the recessed portion is overlapped. Tube 22 may be constructed of hard nylon or another rigid, preferably light weight material.

Figure 3:
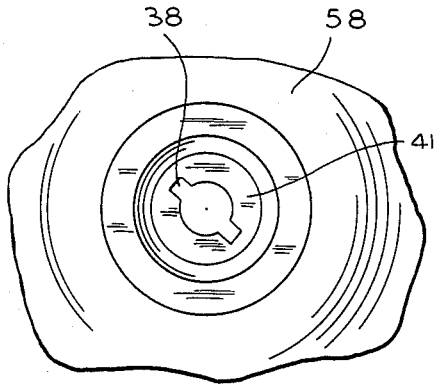
FIG. 3 is the top plan view of the embodiment of FIG. 1 with invention inserted into the finger hole of the bowling ball.
Figure 10:
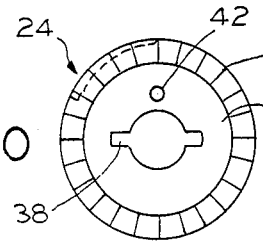
FIG. 10 is a bottom plan view of the cylindrical ring member.

A compression section consists of a cylindrical ring member 24 and a ramp 34, which is preferably an arcuate section that extends vertically upward from the ring member base 27. The thickness of ramp 34 gradually decreases across the width of the section, with longitudinal edge 35 having the most narrow cross section and longitudinal edge 37 having the widest cross section. The bottom of ring member base 25 has a generally circular serrated edge portion 36 as shown in FIG. 10. Extending below serrated portion 36 is cylindrical insert 40, which is preferably integral with member 24. The floor 41 of insert 40, best shown in FIG. 3, includes a centrally located slot 38. Lug 42 extends vertically downward from insert 40. Desirably, the entire compression section is an integral structure molded from plastic with some resiliency, particularly in the ramp section.

Cap 44 is of a truncated pyrimadal cone configuration. Cap 44 has a circular serrated portion 46 that cooperates with serrated portion 36 of the ring member 24. Serrated portion 46 surrounds an upper cap opening 47 which receives insert 40. As detailed in FIGS. 6 and 7, the base 48 of cap 44 has a generally circular opening 50 in communication with an arcuate opening 52. A flange 49 extends circumferentially around cap 44 below the serrated portion 46 (FIG. 1), and a side wall 45 inclines down and inwardly along the outside of cap 44 to terminate at openings 50, 52. Cap 44 may also be molded of plastic.

Figure 4:
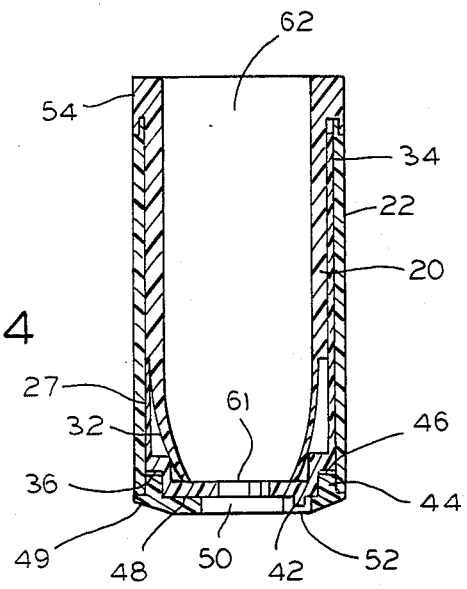
FIG. 4 is a cross-sectional view of the embodiment of FIG. 1 with the inner tube in its relaxed state.
Figure 8:
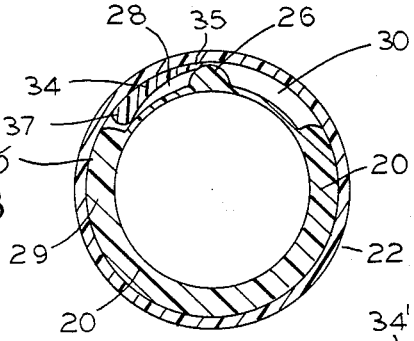
FIG. 8 is a transverse sectional view of the embodiment of FIG. 1 when the inner tube is in its relaxed state.

The telescoped tubes 20, 22, the cylindrical ring member 24, and cap 44 are joined together as follows. Referring to FIG. 4, cylindrical recess 52 of tube 22 cooperates with lip 54 of tube 20, thereby joining telescoped tubes 20, 22 at their tops. A glue or an epoxy is also used at this juncture so that the two tubes do not rotate relative to each other. Cylindrical ring member 24 frictionally fits between tube 20 and tube 22, so that ring member base 27 surrounds the truncated conical wedge 32, and ramp 34 extends along tube 20 to a point below lip 54. Ramp 34 also fits between the telescoped tubes 20, 22 and initially rests in one of the recesses 28, 30, with the thinner longitudinal edge 35 abutting boss 26 and the thicker longitudinal edge 37 abutting surface 25, as shown in FIG. 8.

Figure 6:
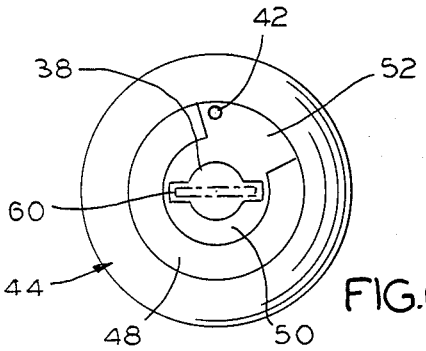
FIG. 6 is a bottom plan view of the embodiment of FIG. 1 when the inner tube is in its relaxed state.

Cap 44 is joined permanently with tube 22 at the bottom of the tube and within opening 53, so that flange 49 engages the bottom edge 55 of tube 22. The serrated portion 46 of cap 44 cooperates with and engages serrated portion 36 of cylindrical ring member 24 when the device is fully assembled. Additionally, lug 42 extends into arcuate opening 52 as shown in FIGS. 6 and 7.

Figure 2:
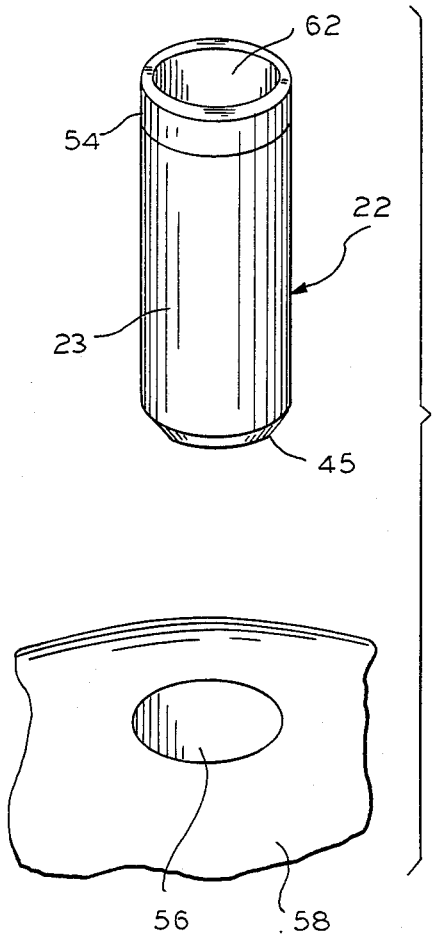
FIG. 2 shows the embodiment of FIG. 1 superimposed over a fingerhole on a bowling ball.
Figure 5:
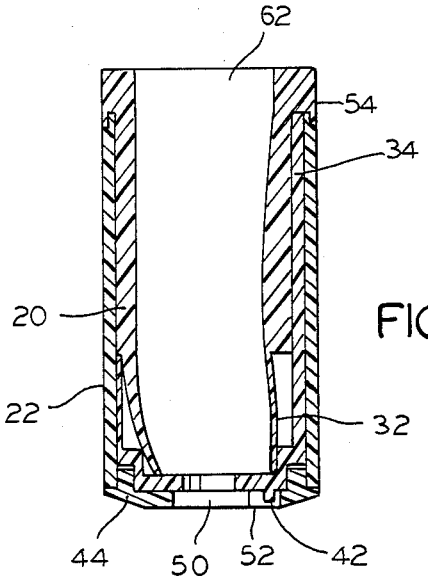
FIG. 5 is a cross-sectional view of the embodiment of FIG. 1 with the inner tube in its constricted state.
Figure 9:
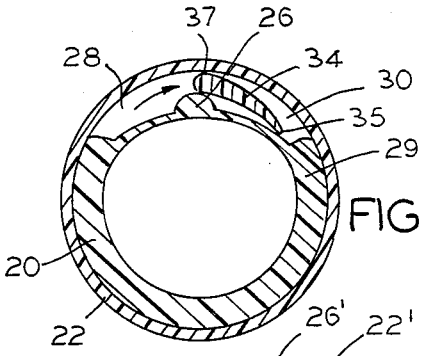
FIG. 9 is a transverse sectional view of the embodiment of FIG. 1 when the inner tube is in its constricted state.

When assembled as described above, the invention operates as follows. Referring to FIG. 2, the outside wall 23 of the outer tube 22 is cemented inside a finger hole 56 of bowling ball 58. The hole 56 is approximately as deep as tube 22 is long. Driver 60 is inserted into hole 62 and engages slot means 38, so that the invention appears as in FIGS. 4, 6, and 8. Upon rotating driver 60, the cylindrical ring member 24 is rotated relative to the stationary telescoped tubes 20, 22, and the serrated portion 36 of ring member 24 rotates relative to the stationary serrated portion 46, until the invention appears as in FIGS. 5, 7, and 9. As shown in FIG. 9, the ramp 34 thereby rotates onto boss 26, maintaining a frictional fit between the ramp and the tubes 20, 22. Since the outer tube restricts outwardly directed radial movement by the ramp, the ramp pushes inwardly on a section of the inner, flexible tube 20. This constricts the hole 62.

Figure 7:
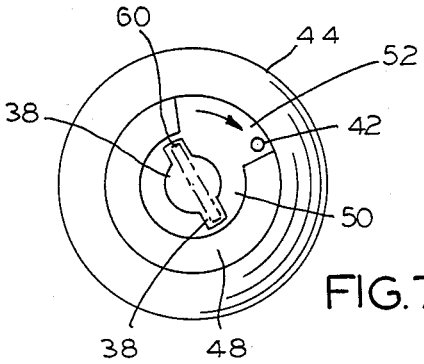
FIG. 7 is a bottom plan view of the embodiment of FIG. 1 when the inner tube is in its constricted state.

Referring to FIG. 7, the cylindrical ring member can be rotated until the lug 42 abuts the opposite side of arcuate opening 52, at which point the ramp overlies the boss as shown in FIG. 9. The amount of constriction of the hole 62 can be varied by the degrees of the rotation of the driver 60 and cylindrical member 24, since the ramp thickness increases in a counterclockwise direction as seen in FIG. 9. Preferably, for bowling ball applications, the serrations are located so that every 10 degrees of rotation causes about 1/64 of an inch of constriction of the hole.

Figure 11:
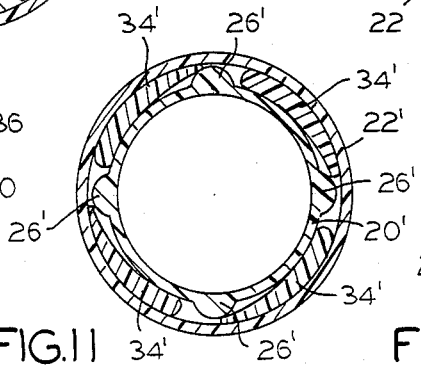
FIG. 11 is a transverse sectional view of a second embodiment of the invention when the inner tube is in its relaxed state.
Figure 12:
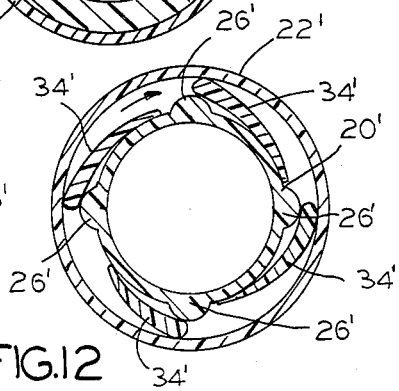
FIG. 12 is a transverse sectional view of the embodiment of FIG. 11 when the inner tube is in its constricted state.

The instant invention, of course, may have more than one boss and engaging ramp. For example, a second embodiment may have a ring member with four bosses 26' and four engaging ramps 34' as shown in FIGS. 11 and 12, but is otherwise identical to the first embodiment. FIG. 11 shows the second embodiment when the inner tube 20' is in its relaxed state. Upon inserting the driver 60 into the slot means 38 and turning, as in the first embodiment, the ramps 34' rotate relative to the telescoped tubes 20' and 22' and over the bosses 26', thereby pushing in a portion of the inner, flexible tube 22' at each of the four boss locations and constricting the inner diameter. Again, the amount of constriction can be varied by the degree of rotation of the driver, since the thicknesses of the ramps 34' vary from one longitudinal edge of each ramp to the other edge. Other numbers of ramps and a corresponding number of bosses can also be employed in the invention.

Those who are skilled in the art will readily perceive how to modify the system. Therefore, the appended claims are to be construed to cover all equivalent structures which fall within the true scope and spirit of the invention.

I claim:

1. A device for adjusting the opening of a hole, comprising:

a coaxial pair of telescoped tubes joined together so that said tubes do not rotate relative to each other, the inner tube of said coaxial pair having an internal bore defining the hole and being constructed at least in part of a flexible material, said inner tube having at least one recess and at least one protruding boss on the outer surface of said inner tube, said inner and outer tubes of said coaxial pair defining a space between them, a compression member positioned in said space between said inner and outer tubes for compressing said inner tube by circumferential movement of said compression member over at least one of said bosses, said compression member restricted from outward radial movement by said outer tube; and means for rotating said compression member in said space to cause said compression member to move between at least one of said recesses of said inner tube and at least one said bosses of said inner tube, thereby changing the compression against said inner tube and adjusting the opening of said bore.

2. The device of claim 1 wherein said compression member includes at least one ramp extending longitudinally in said space between said inner and outer tubes, and wherein one longitudinal edge of said ramp is thinner than the opposite edge of said ramp, the decrease in thickness occurring gradually along the width of said ramp, so that the opening of said internal bore varies with the extent of the rotation of said ramp.

3. The device of claim 2 including a cylindrical ring member that frictionally fits around said inner tube, said cylindrical ring member being affixed to said ramp and having a floor with a slot accessible within said bore, said device also including means for engaging said slot and rotating said compression member.

4. The device of claim 3 including a cap beneath said cylindrical ring member, said cap having an upper serrated edge, and wherein said cylindrical ring member has a serrated edge at its base that engages said serrated edge of said cap and locks the ring member in position relative to said cap, so that the desired size of the opening remains fixed until said compression member is rotated with said slot engaging means.

5. The device of claim 4 wherein said cylindrical ring member further comprises a lug that extends downwardly to engage an opening in said cap, said lug and opening thereby defining the limits of rotation of said ring member.

6. The device of claim 2 wherein there are four recesses, two bosses and two ramps.

7. The device of claim 2 wherein there are four recesses, four bosses and four ramps.

8. The device of claim 1 wherein said inner tube has a top section of substantially uniform inside diameter when said inner tube is in a relaxed state, and wherein said boss extends longitudinally along substantially the entire length of said top section of said inner tube, so that said top section of said inner tube can be compressed along substantially its entire length when the compression member overlies said boss.

* * * * *